US008230661B2

(12) United States Patent
Baratuci et al.

(10) Patent No.: US 8,230,661 B2
(45) **Date of Patent: *Jul. 31, 2012**

(54) CONTINUOUS FLEXIBLE SPACER ASSEMBLY HAVING SEALANT SUPPORT MEMBER

(75) Inventors: James L. Baratuci, Stow, OH (US); Ronald E. Buchanan, London, KY (US); Patrick A. Drda, Lyndhurst, OH (US); Louis A. Ferri, Solon, OH (US); Eric W. Jackson, Willoughby, OH (US)

(73) Assignee: TruSeal Technologies, Inc., Solon, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/017,834

(22) Filed: Jan. 31, 2011

(65) Prior Publication Data

US 2011/0239561 A1 Oct. 6, 2011

Related U.S. Application Data

(63) Continuation of application No. 12/391,339, filed on Feb. 24, 2009, now Pat. No. 7,877,958, which is a continuation of application No. 11/103,845, filed on Apr. 12, 2005, now Pat. No. 7,493,739, which is a continuation-in-part of application No. 10/442,574, filed on May 21, 2003, now Pat. No. 6,877,292, which is a continuation-in-part of application No. 09/692,919, filed on Oct. 20, 2000, now Pat. No. 6,581,341.

(51) Int. Cl.

| | |
|---|---|
| ***E04C 2/54*** | (2006.01) |
| ***E06B 3/00*** | (2006.01) |
| ***E06B 7/12*** | (2006.01) |

(52) U.S. Cl. ..... 52/786.13; 52/204.5; 52/172

(58) Field of Classification Search ..... 52/786.1, 52/786.11, 786.13, 172, 204.5, 842, 851, 52/856; 428/34, 181

See application file for complete search history.

(56) References Cited

U.S. PATENT DOCUMENTS

| | | | | | |
|---|---|---|---|---|---|
| 2,271,180 | A | * | 1/1942 | Brugger | 428/119 |
| 2,828,235 | A | * | 3/1958 | Holland et al. | 428/118 |
| 4,431,691 | A | * | 2/1984 | Greenlee | 428/34 |
| 4,576,841 | A | * | 3/1986 | Lingemann | 428/34 |
| 4,745,711 | A | * | 5/1988 | Box | 52/172 |
| 4,791,773 | A | * | 12/1988 | Taylor | 52/786.13 |
| 4,835,130 | A | * | 5/1989 | Box | 502/62 |
| 5,013,377 | A | * | 5/1991 | Lafond | 156/109 |
| 5,120,584 | A | * | 6/1992 | Ohlenforst et al. | 428/34 |
| 5,209,034 | A | * | 5/1993 | Box et al. | 52/171.3 |
| 5,270,091 | A | * | 12/1993 | Krysiak et al. | 428/68 |
| 5,436,040 | A | * | 7/1995 | Lafond | 428/34 |
| 5,441,779 | A | * | 8/1995 | Lafond | 428/34 |
| 5,443,871 | A | * | 8/1995 | Lafond | 428/34 |
| 5,447,761 | A | * | 9/1995 | Lafond | 428/34 |
| 5,472,558 | A | * | 12/1995 | Lafond | 156/523 |

(Continued)

*Primary Examiner* — Jessica Laux
*Assistant Examiner* — Elizabeth A Plummer
(74) *Attorney, Agent, or Firm* — Renner, Otto, Boisselle & Sklar, LLP

(57) ABSTRACT

A spacer and sealant assembly comprising a sealant support member having a planar surface bounded by first and second edges wherein said first and second edges have at least one pleated portion, a plastic shim having at least one undulating portion in contact with said first and second edges of said stretchable sealant support member so that said at least one pleated portion is oriented inward into said at least one undulating portion of said shim, a sealant joined to at least said first and second edges of said sealant support member.

26 Claims, 3 Drawing Sheets

U.S. PATENT DOCUMENTS 5,485,710 A * 1/1996 Lafond ..... 52/204.593
5,491,953 A * 2/1996 Lafond ..... 52/786.13
5,498,451 A * 3/1996 Lafond ..... 428/34
RE35,291 E * 7/1996 Lafond ..... 156/109
5,616,415 A * 4/1997 Lafond ..... 428/411.1
5,635,019 A * 6/1997 Lafond ..... 156/574
5,650,029 A * 7/1997 Lafond ..... 156/107
5,656,358 A * 8/1997 Lafond ..... 428/192
5,658,645 A * 8/1997 Lafond ..... 428/192
5,691,045 A * 11/1997 Lafond ..... 428/304.4
5,759,665 A * 6/1998 Lafond ..... 428/122
5,762,738 A * 6/1998 Lafond ..... 156/107
5,773,135 A * 6/1998 Lafond ..... 428/304.4
5,806,272 A * 9/1998 Lafond ..... 52/786.13
5,813,191 A * 9/1998 Gallagher ..... 52/786.13
5,851,609 A * 12/1998 Baratuci et al. ..... 428/34
5,876,554 A * 3/1999 Lafond ..... 156/500
5,888,341 A * 3/1999 Lafond ..... 156/468
5,975,181 A * 11/1999 Lafond ..... 156/523
6,001,453 A * 12/1999 Lafond ..... 428/122
6,035,602 A * 3/2000 Lafond ..... 52/786.13
D422,884 S * 4/2000 Lafond ..... D8/354
6,115,989 A * 9/2000 Boone et al. ..... 52/786.13
6,131,363 A * 10/2000 Phillips ..... 52/786.11
6,131,364 A * 10/2000 Peterson ..... 52/786.13
6,148,890 A * 11/2000 Lafond ..... 156/361
6,192,652 B1 * 2/2001 Goer et al. ..... 52/786.13
6,250,358 B1 * 6/2001 Lafond ..... 156/500
6,329,030 B1 * 12/2001 Lafond ..... 428/34
6,351,923 B1 * 3/2002 Peterson ..... 52/786.13
6,355,328 B1 * 3/2002 Baratuci et al. ..... 428/68
6,528,131 B1 3/2003 Lafond
6,581,341 B1 * 6/2003 Baratuci et al. ..... 52/204.5
6,665,995 B2 * 12/2003 Deane ..... 52/786.13
6,877,292 B2 * 4/2005 Baratuci et al. ..... 52/786.13
6,989,188 B2 * 1/2006 Brunnhofer et al. ..... 428/188
7,107,729 B2 * 9/2006 Baratuci et al. ..... 52/204.593
7,493,739 B2 * 2/2009 Baratuci et al. ..... 52/786.13
7,877,958 B2 * 2/2011 Baratuci et al. ..... 52/786.13
2004/0020162 A1 * 2/2004 Baratuci et al. ..... 52/786.13
2009/0223150 A1 * 9/2009 Baratuci et al. ..... 52/204.593

* cited by examiner

CONTINUOUS FLEXIBLE SPACER ASSEMBLY HAVING SEALANT SUPPORT MEMBER

This application is a continuation of U.S. patent application Ser. No. 12/391,339 filed on Feb. 24, 2009 and issued on Feb. 1, 2011 as U.S. Pat. No. 7,877,958, which is a continuation of U.S. patent application Ser. No. 11/103,845 filed on Apr. 12, 2005 and issued on Feb. 24, 2008 as U.S. Pat. No. 7,493,739, which is a continuation-in-part of U.S. patent application Ser. No. 09/692,919 filed on Oct. 20, 2000 and issued on Jun. 24, 2003 as U.S. Pat. No. 6,581,341, which was also filed as PCT/US01/45686 and published on Sep. 19, 2002 as WO 02/071904, and U.S. patent application Ser. No. 10/442,574 filed on May 21, 2003 and issued as U.S. Pat. No. 6,877,292, which is a continuation-in-part of U.S. Pat. No. 6,581,341 and which are incorporated herein by reference in their entirety.

FIELD OF INVENTION

This invention relates to a composite spacer and sealant which can be used particularly in the fabrication of thermal insulating laminates such as windows.

BACKGROUND OF INVENTION

In general, the procedure for assembling an insulated window assembly involves placing one sheet of a glazed structure over another in a fixed, spaced relationship, and then injecting a sealant composition into the space between the two glazed structures, at and along the periphery of the two structures, thereby forming a sandwich-type structure having a sealed air pocket between the structures. In practice, glazed structures are typically glass sheets, but can also be plastic or other such suitable materials. To keep the glazed structures properly spaced apart, a spacer, such as a metal bar, is often inserted between the two structures to maintain proper spacing while the sealant composition is injected into place. Also, the spacer and sealant can be prefabricated into a solitary unit and after fabrication placed into the space between the glazed structures to form the window structure.

Moisture and organic materials are often trapped inside the sealed air space as a result of the window assembly fabrication process. To minimize the effects of moisture and organic materials trapped in the sealed air pocket, desiccants can be used as a medium to absorb these artifacts. Typically, however, at least some moisture will diffuse into the sealed air pocket during the time the window assembly is in field service.

This use of desiccants keeps moisture concentration low and thus prevents the moisture from condensing on and fogging interior surface of the glass sheets when the window assembly is in service. Desiccants can be incorporated into the spacer, into the sealant or into the entire sealant/spacer when the sealant/spacer assembly is a solitary component. Additional desiccant above the amount required to absorb the initial moisture content is included in the spacer/sealant assembly in order to absorb additional moisture entering the window assembly over its service life.

Various prior art practices for manufacturing windows are cumbersome, labor intensive or require expensive equipment. An answer to the previously discussed limitations is provided by U.S. Pat. No. 4,431,691, to Greenlee, in which a sealant and spacer strip having a folded or contoured spacer means to maintain the relative distance under compression of glass sheets, wherein the strip comprises a folded or contoured spacer means embedded or enveloped in a deformable sealant. This spacer strip has the advantage of being flexible along its longitudinal axis to enable it to be coiled for storage. The Greenlee assembly is thus a solitary component in which the sealant contains the desiccant.

Greenlee's assembly, while addressing previous limitations does not provide a flat sight line once the glass unit is constructed due to undulations in the spacer after the glazed structure are compressed into place. The sightline in a window is the portion of the spacer/sealant assembly that is viewed through the glass sheets, but is not in contact with these sheets. This flat sightline is desirable to improve aesthetic qualities of installed windows. Also, the Greenlee teaching uses high amounts of sealant material required to envelope the spacer and the folded assembly can be stretched during application as well as along its longitudinal axis. This stretching can also lead to problems in maintaining a flat sightline.

To resolve some of Greenlee's shortcomings, U.S. patent application Ser. No. 08/585,822 (abandoned), filed in the PCT as PCT/US97/00258 and published as WO97/26434 (abandoned) shows use of a continuous flexible spacer assembly having a shim connected to stiffener resulting in a longitudinal flexible spacer strip. The spacer assembly has a so-called "open cell" construction. While this construction solves some of Greenlee's problems associated with the sightline, the open cell construction does not provide adequate support to the sealant when in contact with the glass sheets. Accordingly, this shim/stiffener construction is not suitable for maintaining a sealed window assembly over extended periods because the spacer/member bond, i.e. the bondline, tends to lose adhesion and become unsealed.

SUMMARY OF THE INVENTION

There remains a need for an improved flexible continuous spacer assembly that eliminates longitudinal stretching and, accordingly, makes it easier to consistently produce a window having a smooth sightline. Moreover, it would be desirable if such assembly allowed for a sharper radius when bending the sealant and spacer at the corners as compared to the prior art. Also, a need exists for improved lateral stability of the strip, while providing a more cost-effective product having the benefits of the Greenlee construction and other prior art. Finally, the assembly would provide the required support to maintain the adhesive seal between the spacer assembly and the glazed structures over the life of the window unit.

Thus, the sealant and spacer strip of the present invention provides the advantages over the prior art of eliminating the amount of necessary sealant material while maintaining the performance of the sealant and spacer strip; eliminating the tendency of the material to stretch along its longitudinal axis; improving the appearance of the sightline of the window; improving the durability of the bondline and providing the necessary ability to form sharper corners.

The present invention also provides an improved, longitudinally flexible, but laterally stable sealant and spacer assembly for application in the assembly of multiple glazed structures as well as for other laminates which can be coiled for storage and easier application.

In accordance with one aspect of the present invention, there is provided a flexible, crush-resistant sealant and spacer strip or composite tape structure comprising a longitudinally extending spacer, including an undulating strip of rigid material, a longitudinally coextending planar strip of a stiffener material and a longitudinally coextending sealant support member which is joined to the edges of the undulating strip and stiffener material. A deformable adhesive sealant is also included which seals the stiffener, shim and sealant support member to the glass sheets. The spacer is capable of resisting compressive forces exerted in a direction normal to a plane in which the longitudinal axis of the spacer lies, is in cooperation with the stiffener and maintains the ability to be coiled for storage. In accordance with another aspect of the present invention, there is provided a flexible, crush-resistant sealant and spacer strip comprising longitudinally extending spacer, including an undulating strip or shim of a plastic or rigid polymeric material, a longitudinally coextending planar strip of a stiffener material and a longitudinally coextending sealant support member, which is joined to the edges of the shim and stiffener. It is also contemplated that the shim and stiffener can be fabricated as an integrated, one-piece structure. An adhesive sealant is also provided as is a desiccated topcoat.

DETAILED DESCRIPTION

Figure 1:
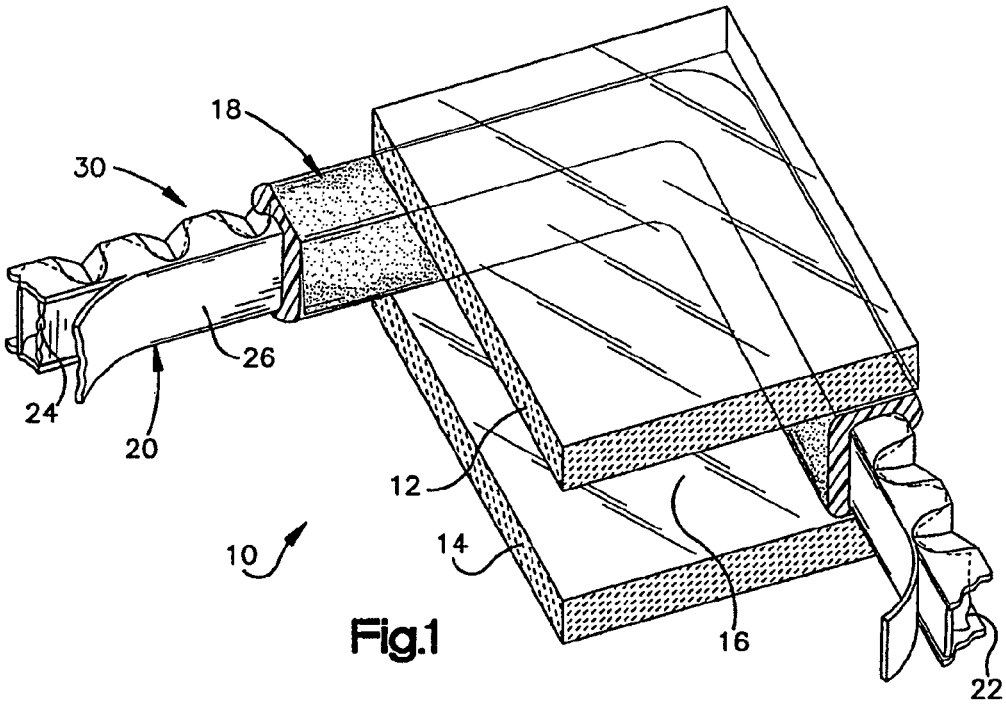
FIG. 1 is a fragmentary perspective view with parts in section showing an embodiment of a window made in accordance with the present invention.

Referring now to the drawings, it will be seen that FIG. 1 illustrates a composite structure, such as but not limited to a window assembly, 10 comprising first substrate member 12 and second substrate member 14 having facing, generally parallel surfaces. First and second substrate members 12, 14 and are generally glass panes of a multiple glazed structure. The substrate members are 12, 14 joined together to form an enclosed space 16 that is hermetically sealed by a composite tape structure, i.e., sealant and spacer strip, which includes sealant 18 which at least partially envelopes a spacer assembly 20. Members 12, 14 are formed of glass. However, it will be appreciated that the invention has applicability in the environment of an unrestricted variety of construction or structural materials, including, for example, cement, concrete, brick, stone, metals, plastics, and wood.

In accordance with a preferred embodiment of the invention, the spacer assembly 20 includes an undulating strip of rigid material, i.e., a "shim" 22, a generally planar strip of rigid material, i.e., a stiffener 24 which is coextending with, and preferably intermittently joined to the shim 22 at the peak of each of the undulations on one side of the shim 22 and a sealant support member 26. The spacer assembly 20 is generally characterized as a linear series of adjoining hollow columns which may comprise tubular or prismatic cells. Thus, the spacer assembly 20 can loosely be referred to as "honey-combed." By "undulating," it is meant that the shim 22 has a repeating contour which gives edge-to-edge structural integrity in the "z" direction, i.e., parallel to the long axis of the cells as illustrated in FIG. 3. The undulations may include folds, ribs, creases, and sinusoidal waves having a cross-sectional profile which can be curved or angular or any combination thereof. Typically, the undulations will have a "peak" and a corresponding "valley" as is understood in the art and illustrated in FIG. 2. The amplitude of the shim 22 is the peak-to-peak distance.

As illustrated in FIGS. 1 and 3, for purposes of this patent, "interior" means facing into the sealed air pocket 16 of the window assembly 10 while "exterior" means facing out of the sealed air pocket 16 of the window assembly 10. Also, FIG. 3 illustrates the orientation of the x, y, and z axes as used herein.

A particularly favorable undulating shim 22 profile includes flat surfaces at the peaks of the undulations which can be adhered to the sealant support member 26 with the stiffener 24 resting or attached to an interior surface of the sealant support member 26 relative to the interior of the window assembly 10. However, it should be appreciated that the stiffener 24 could be attached to the opposing interior surface of the sealant support member 26 and still achieve the same benefits. Further, the undulations provide the shim 22 with a profile which is capable of resisting compressive forces in the "z" direction.

Consequently, spacer assembly 20 is "crush-resistant," i.e., capable of resisting forces tending to reduce the spacing between members during use. Moreover, the spacer assembly 20 with stiffener 24 is more resistant to torque or twisting about the longitudinal axis than the shim 22 by itself. This aspect of the invention facilitates the ease application of this spacer assembly 20 while reducing the twist due to torsion forces since prior art spacers tended to twist during assembly of multiple glazed structures. It should be understood that it would be within the scope of the invention to construct the spacer assembly 20 as a single unit rather than an assembly of components.

The shim 22 can be formed of any material having sufficient rigidity to resist compressive forces exerted in a direction normal to the parallel planes in which the edges of the undulating strip lie. Suitable materials include steel, stainless steel, aluminum, coated paper, cardboard, plastics, foamed plastics, metallicized plastics or laminates of any combination of the above.

The undulations of the shim 22 are generally transverse to the longitudinal axis to ensure flexibility for coiling or winding about the z-axis.

The frequency of the undulations may range from 1 to about 10 per inch, preferably from about 2 to about 8 per inch, and most preferably from about 2 to about 5 per inch, while the total amplitude, i.e., thickness of the crest and trough together in the x-y plane, is from about 0.05 to about 0.5 inch with from about 0.08 to about 0.25 inch being preferred.

For some applications, however, one of skill in the art will readily appreciate that larger configurations may be needed.

In accordance with the present invention, the compressive load strength of the spacer assembly 20 is augmented by the presence of the stiffener 24, which is coextensive with the shim 22. The stiffener 24 is preferably in cooperation with the peaks in the undulations of the shim 22.

The stiffener 24 may be fabricated from plastic, aluminum, steel, stainless steel, coated paper or any thermoset or thermoplastic foam as well as any laminate made from any combination of the above list.

In one embodiment of the present invention, the shim 22 is fabricated from plastic or any other suitable polymeric material. It is also contemplated that the shim 22 and stiffener 24 can be fabricated as a one-piece, integrated construction. When the shim 22 and stiffener 24 is a one-piece, integrated construction, it can be either all-metal or all-plastic. In the case of an all metal integrated construction the shim would be formed into the undulating configuration and the stiffener joined to the peaks of the shim by welding, soldering, or other all metal joining techniques. In the case of an all plastic integrated construction the plastic shim would be formed into the undulating configuration and the plastic stiffener would be joined to the peaks of the shim by fusing the materials together using ultrasonic welding and pressure or localized heating and pressure. The stiffener may also be extruded and joined to the peaks of the shim shortly after extrusion while the temperature of the stiffener is at or near its softening point. The integrated shim and stiffener assembly can also be made from sheet materials which are joined as above and then slit to the desired width. Alternatively the stiffener and shim extruded as one piece in a sheet where the direction of extrusion is parallel to the undulations. The sheet material is then slit transverse to the undulations to the desired width for use in the spacer assembly. When utilizing a one-piece, integrated shim/stiffener assembly, the sealant support member is attached to the shim/stiffener assembly in the same manner as when using separate shim 22 and stiffener 24, as described below.

The shim 22 is attached to an exterior surface of the sealant support member 26. One method of adhering the sealant support member 26 and the shim 22 is for the sealant support member 26 to include an adhesive layer which is intermediate to the sealant support member 26 and the shim 22. This adhesive layer may be a curable adhesive. The adhesive may be cured after fabrication of the spacer assembly 20, but before it is placed into a window assembly 10 or it may be cured after manufacture of the window assembly 10 incorporating the space assembly 20 is completed. The adhesive may cured after fabrication of the spacer assembly 20, but before manufacture of the window assembly 10 in order to minimize flex or twist of the spacer assembly 20 during manufacture of the window assembly 10. Curing after manufacture of the window assembly may be desirable in order to increase the overall strength of the spacer assembly 20 after it has been incorporated into the window assembly 10.

Suitable thicknesses for the sealant support member 26 range from about 0.001 to about 0.06 inch, preferably from about 0.001 to about 0.03 inch, and most preferably from about 0.002 to about 0.015 inch. The shim 22 has a thickness of from about 0.003 to about 0.06 inch, preferably from about 0.003 to about 0.04 inch, and most preferably from about 0.005 to about 0.01 inch when the shim 22 is formed from a metallic material. When the shim is formed from plastic, it has a thickness from 0.005 to 0.120, and preferably from 0.006 to 0.030 inch. The stiffener has a thickness of from about 0.005 to 0.060 inches and most preferably from 0.006 to 0.030 inches. These ranges will be used in the typical window assembly 10 with one of skill in the art readily appreciating that larger ranges may be utilized if necessary.

The sealant support member 26 may be fabricated from aluminum foil, plastic, paper, plastic paper, metallicized plastic, metal or laminates formed from any suitable combination such that the sealant support member 26 is stretchable so that it does not tear or bunch when the spacer assembly 20 is being bent to form corners. If the sealant support member 26 tears, it does not support the sealant 18 properly and the torn section cannot function as a moisture vapor barrier. If the sealant support member 26 bunches up when forming corners, the spacer assembly 20 increases in size in the transverse direction resulting in deformation of the sealant 18 along the bondline. The original sealant area available to engage the substrate will be reduced, weakening the corner area and it will be more difficult to achieve the desired spacing between the substrates 12, and 14. Pleats facilitates corner forming by decreasing the degree of stretching of the sealant support member must undergo during corner forming, but some stretching of the sealant support member is still required.

A laminate film that is suitable as the sealant support member 26 is a film having layers of polyester, aluminum foil and a copolymer. A laminate film of this construction can resist stresses at high temperatures to which the sealant support member 26 is exposed to during fabrication of the spacer assembly 20 and application of the sealants. The same film can easily form corners at room temperature because it is tear-resistant, yet stretchable to avoiding bunching at the corner. Another laminate film that is suitable for use as the sealant support member 26 is a laminate film having layers of nylon, aluminum foil and polyethylene copolymer.

The sealant 18 seals the gap formed between the sealant support member and the substrate surfaces 12, 14. Thus at least the two longitudinal edges of the sealant support member 26 include longitudinally extending ribbons of sealant 18 which are of sufficient width to provide a low-permeability seal. In particular, the sealant 18 adheres to at least the opposing longitudinal edges of the sealant support member 26. The sealant 18 may also include a lateral face so as to have generally a U-shaped cross-section.

Suitable dimensions for the composite sealant and spacer assembly 30 will depend upon the window construction with the length corresponding generally to the window perimeter length. The width will correspond to the desired spacing between the glazed structures. The spacer assembly 20, however, will often be slightly smaller than the desired spacing between the glazed structures 12, 14 with the addition of the sealant 18 to the assembly resulting in a slightly greater width than the desired spacing. The desired spacing is obtained during manufacture when the glazed structures 12, 14 are pressed into the final desired thickness. It should be understood, however, that the present invention can be manufactured in continuous lengths for any desired length resulting in flexibility for any application.

The shim 22 can be manufactured by any of various methods. For example, it can be extruded, stamped, pressed, vacuum-molded, or crimped, depending upon the material used. The shim 22 can be joined to the stiffener 24 by any suitable means such as by welding, thermally fusing, joining with adhesives or by crimping the shim 22 to the stiffener 24. The stiffener 24 can also be joined to the sealant support member 26 by similar such treatments.

The sealant 18 can subsequently be applied to the spacer assembly 20 such as by dipping, painting, injecting or extruding the sealant 18 to the lateral edges of the sealant support member 26.

Figure 3:
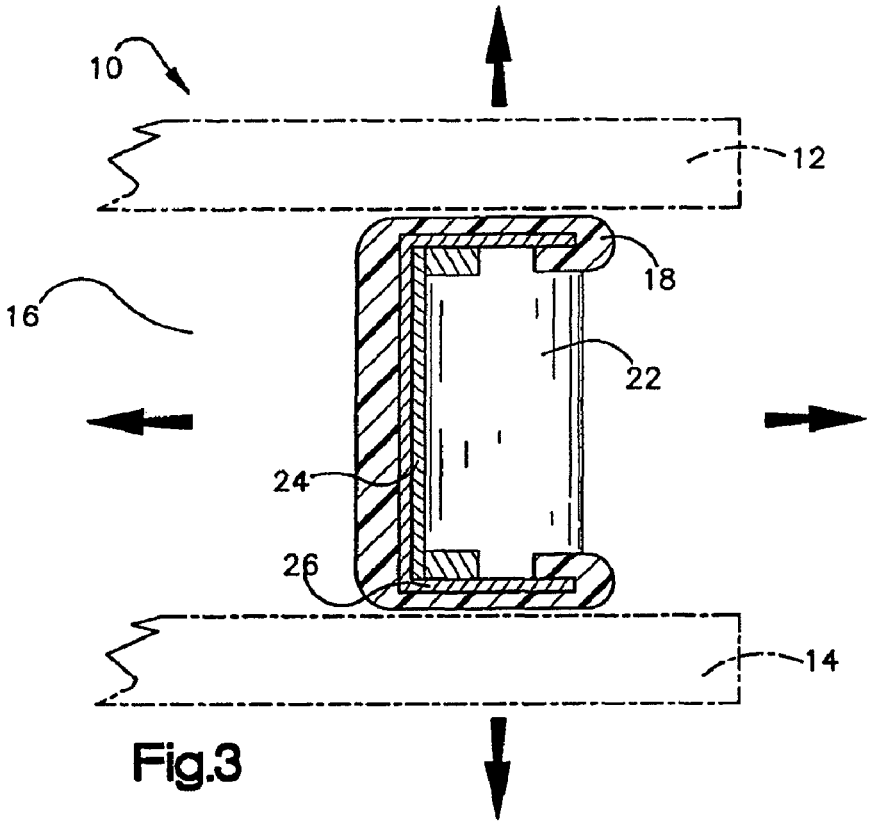
FIG. 3 is a cross-section of the spacer assembly of the embodiment of FIG. 1.
Figure 3A:
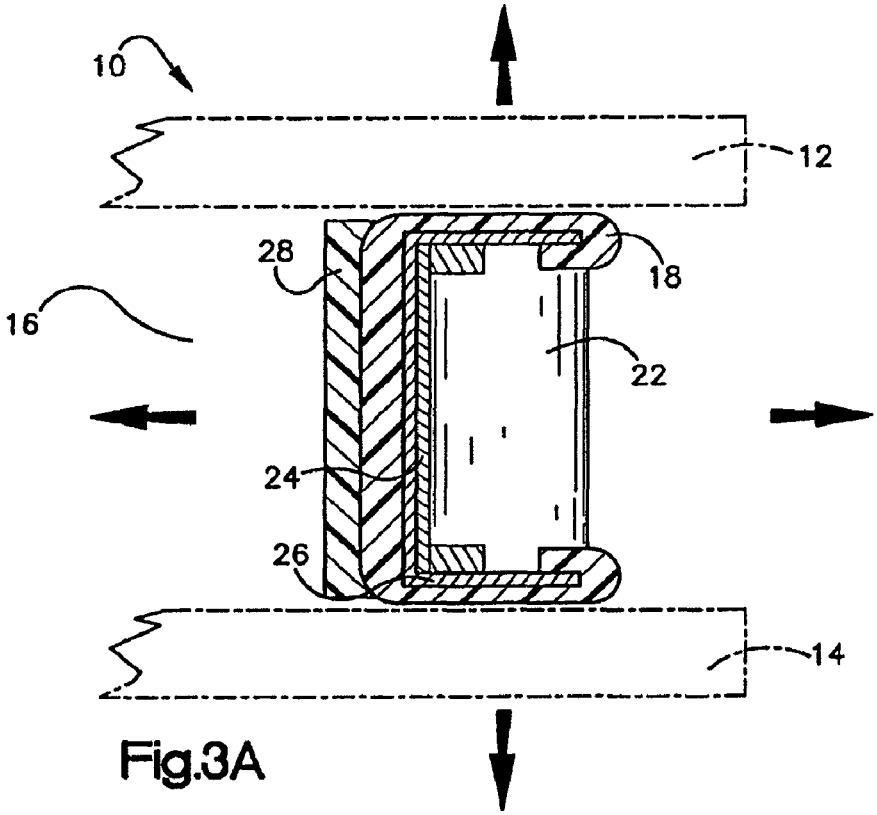
FIG. 3A is a cross-section of the spacer assembly of the present invention showing use of a topcoat.
Figure 4:
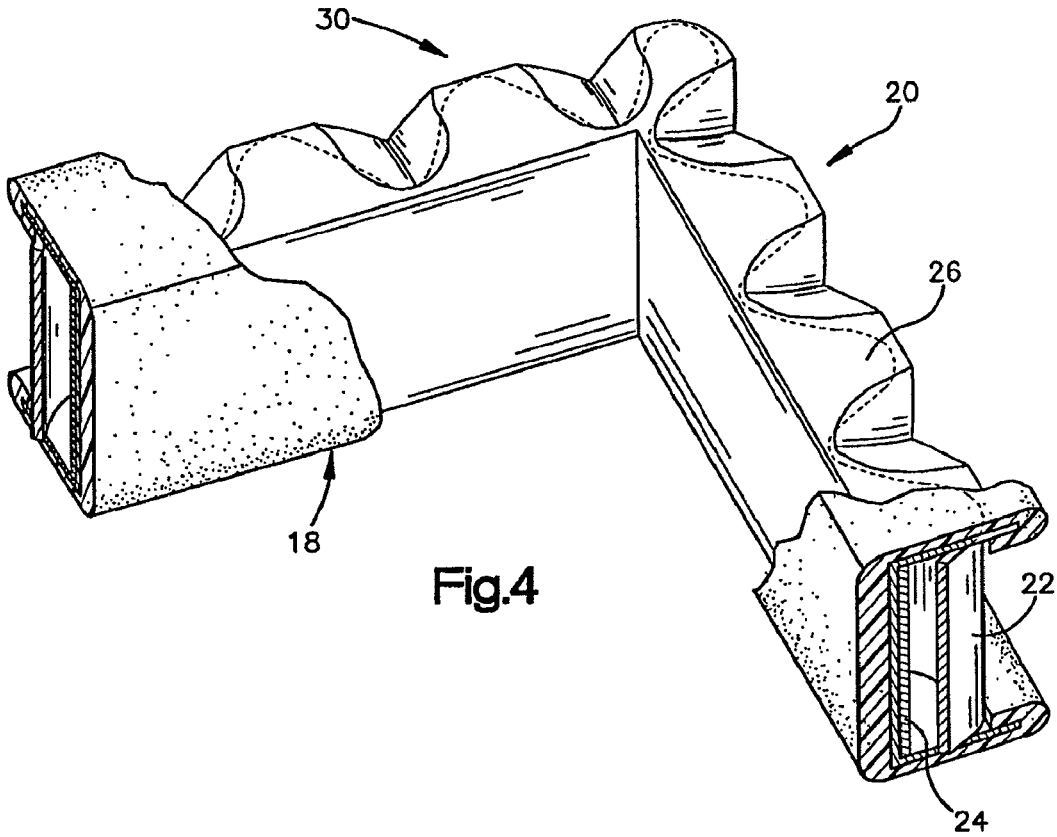
FIG. 4 is a perspective view of the spacer in accordance with the preferred embodiment of the present invention.

Desiccant can be carried in the sealant 18 and the sealant/desiccant can be applied to the edges and interior surface of the sealant support member 26 in a single step. In another embodiment, as illustrated in FIG. 3A, a topcoat 28 containing desiccant is adhered to the sealant 18 on its interior surface(s). By using the desiccated topcoat 28, a desiccated sightline is formed. Alternatively, the desiccant can be applied to the sealant support member 26 facing the interior of the window.

The spacer assembly 20 of the preferred embodiment, comprising a shim 22 attached to a stiffener 24 with both secured to a sealant support member 26 to define a honeycomb or cellular structure, has several important advantages over the prior art. The columnar aspect shim 22, sealant support member 26 and stiffener 24 of the spacer assembly 20 improves its compressive strength and improves the resistance to torque about the longitudinal axis.

Moreover, the stiffener 24 and the sealant support member 26 act as a longitudinally stable backing that inhibit the shim 22 from stretching along its longitudinal axis. Furthermore, the sealant support member 26 improves the bondline formed between the sealant 18 and the glazed structures 12,14 by keeping the sealant 18 in contact with both glazed members 12,14.

Figure 2:
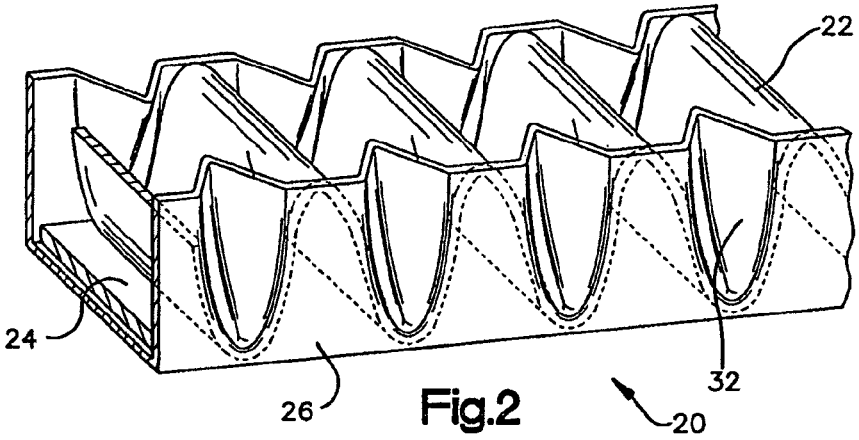
FIG. 2 is a fragmentary perspective view of a spacer in accordance with the present invention.

As best illustrated in FIG. 2, the sealant support member 26 may be pleated or crimped to facilitate forming corners. Pleated as used herein means any formation in the sealant support member 26 that allows stretching when forming corners. Thus, as used herein, pleated includes pleats, gussets, crimps or folds. The pleats 32 of the sealant support member 26 allow for sharper corners without tearing or otherwise damaging the spacer assembly 20. The pleats 32 also provide for flexibility necessary to bend the sealant/spacer assembly 30 into corners and to allow for coiling of the sealant/spacer assembly 30.

In a preferred embodiment of the invention, the planar face of the sealant support member 26 is interior of the shim 22 and carries a sealant 18 and/or topcoat 28 along the sight line. However, it should be understood that the fabrication of the sealant/spacer assembly 30 may be reversed so that the undulations of the shim 22 carry the sealant 18 and/or topcoat 28 and form the sight line, and the sealant support member 26 is substantially free from sealant and faces the exterior of the window assembly 10. Finally, the sealant/spacer assembly 30 serves to displace sealant as taught in the prior art so as to reduce the sealant adhesive which is necessary to achieve an effective seal. This results in a substantial reduction in the amount of sealant used.

As previously noted, elongated ribbons of deformable sealant 18 are carried by at least the lateral edges of spacer assembly 20. The thickness to which elongated ribbon extends beyond the surfaces and edges of spacer assembly 20 is not critical as an absolute measurement, but is important in terms of functional considerations. For most applications, where the surfaces of the two members 12, 14 being sealed are relatively smooth, the thickness of the sealant 18 extending beyond the spacer assembly 20 should be in the range of 0.005-0.015 inch for each edge after the sealant 18 is compressed between the members 12, 14. For other applications as well as applications where the two members 12, 14 are relatively smooth, the thickness of the sealant 18 extending beyond the spacer assembly 20 can, however, be in the range of 0.010 to 0.025 inch for each edge after the sealant 18 is compressed between the members 12, 14.

Because the surfaces of tempered glass may not be as flat as the surfaces of untempered glass, somewhat greater thicknesses may be required to provide tempered glass with an adequate seal.

The term "deformable" as used herein, is intended to characterize a sealant, whether thermoplastic, thermosetting, or thermoplastic thermosetting, which when used in the fabrication of composite structures 10 contemplated by this invention, is at least initially incapable of resisting deforming forces exerted upon it. Thus, the term deformable is intended to characterize a material which resists deformation or flow under low forces placed on a window assembly 10 throughout its lifetime, but is readily deformable under higher forces encountered during manufacture of a window assembly 10.

A wide variety of materials may be used as the base for the adhesive sealant 18, including polysulfide polymers, urethane polymers, acrylic polymers, and the styrene-butadiene polymers. Included among the latter are a class of thermoplastic resins which, when below their flow temperature, exhibit elastic properties of vulcanized polymers. Such resins are sold by Shell Chemical Co. under the trademark "Kraton." A preferred class of sealants 18 is butyl rubbers.

The adhesive sealant 18, however, is preferably a pressure sensitive adhesive which is thixotropic. It should be readily apparent, however, that the sealant 18 can also be a curing adhesive where the adhesive is applied in an uncured state to the members 12, 14 and subsequently the cured by the input of energy through known methods such as actinic radiation, radio frequency radiation, infrared radiation, electromagnetic induction radiation or by atmospheric agents such as moisture or oxygen. The cure can be activated during manufacture of the spacer and sealant assembly or after the members 12, 18 and spacer assembly 20 are assembled into a window assembly 10.

If a topcoat 28 is applied, the topcoat 28 is preferably a desiccant loaded, deformable material. One of skill in the art, however, should appreciate that the topcoat could also be a desiccant loaded, non-deformable material. Where the material is not deformed or the aesthetic characteristics changed or marred under the high forces and handling encountered during manufacturing of a window assembly.

Window assemblies 10 often require a desiccant to lower the concentration of moisture and organic materials trapped in the air space 16 between the two glazed structures 12,14 of the window assembly 10.

Conveniently, in the present invention, the desiccant can be incorporated within the deformable adhesive sealant 18 and this can be applied to the front face of the assembly or, alternatively, a different material containing desiccant can be used and co-extruded or otherwise applied to the sight line of the spacer means. A particularly suitable class of desiccant is synthetically produced crystalline zeolite sold by UOP Corporation under the name "Molecular Sieves." Another desiccant which may be used is silica gel. Combinations of different desiccants are also contemplated.

In a preferred embodiment, the back or exterior face of the shim 22 is substantially free from sealant 18 and more particularly is substantially free from sealant 18 which includes a desiccant. By "substantially free" it is meant that at least one-third and more preferably one-half or even three-fourths (depending on the ultimate window gap width) of the exterior surface of the shim 22 is free of sealant 18. More specifically, the peaks of the shim 22 may contain the sealant 18, but the valleys of the shim 22 will be relatively free from the sealant 18. As is shown in FIG. 3, the sealant 18 and/or topcoat 28 is advantageously U-shaped before it is applied to the window assembly 10. Thus, the sealant 18 and/or topcoat 28 extends along the lateral face of the spacer assembly 20, i.e., the sightline, and along the lateral edges, i.e., the bondline.

The preferred method of manufacturing the sealant/spacer assembly 30 in accordance with the present invention is by co-extrusion.

This can be accomplished with commercially available co-extruding equipment which, in some instances, may require minor modification. In general, a previously formed or pre-formed spacer assembly 20 is fed through the center of an extrusion die and the deformable sealant 18 is extruded about the spacer assembly 20 leaving its exterior surface substantially free from sealant 18. The composite material is then fed through a sizing die to obtain a sealant/spacer assembly 30 having the desired outside dimensions and the proper thickness of sealant 18 extending beyond the spacer assembly 20. A releasable liner or paper is contacted longitudinally along the sightline for ease of coiling. As the sealant/spacer assembly 30 is applied to form a window assembly 10, the releasable liner is removed and discarded. One of skill in the art will readily appreciate that other well known methods may be used to produce the invention. In one embodiment, the spacer assembly 20 of the present invention is constructed by forming the shim 22 by passing it through intermeshing gears to make the undulations. After the shim 22 is formed, the stiffener 24 is joined to the shim 22 using an adhesive. The adhesive can be placed on the stiffener 24 immediately before being joined to the shim 22 or the adhesive can be pre-applied to the stiffener. The now joined shim/stiffener can then be joined to the sealant support member 26 also using an adhesive. In one embodiment, the shim/stiffener are centered on a flat sealant support member 26 bearing an adhesive. Opposing edges of the sealant support member 26 are then folded to contact the sides of the shim 22. The sealant 18 and if desired, the topcoat 28, are then adhered to the spacer assembly 20 as previously described. While one of skill in the art will appreciate that any variety of adhesives may be used, it is preferred that the adhesives maintain a degree of flexibility within the spacer assembly 20.

Alternately, the sealant 18 may be extruded onto both edges of the pre-formed spacer assembly 20 and a topcoat 28 may simultaneously or sequentially be applied to the front lateral surface of the spacer assembly 20, such as by co-extrusion, coating, or other lamination techniques. This topcoat 28 may be a different material from the sealant 18 and may be formulated for aesthetic purposes, for desiccating purposes, or other reasons.

Finally, while the embodiments described herein relate to window assemblies having two glazed structures, one of skill would readily understand that window assemblies having multiple glazed structures such as triple-paned window assemblies can be formed using the present invention. In another embodiment, a groove or indentation is formed in the sealant 18 and/or topcoat 28 along the sightline. A glazed member can be placed into this groove to form a triple-paned window assembly.

While in accordance with the patent statutes the best mode and preferred embodiment has been set forth, the scope of the invention is not limited thereto, but rather by the scope of the attached claims.

What is claimed is:

1. A spacer and sealant assembly comprising: a stretchable sealant support member having a planar surface bounded by first and second edges wherein said first and second edges have at least one pleated portion; a shim having at least one undulating portion in contact with said first and second edges of said stretchable sealant support member so that said at least one pleated portion and the shim is configured to facilitate bending; and a sealant joined to at least said first and second edges of said sealant support member.

2. The spacer and sealant assembly of claim 1 further comprising a stiffener in contact with said stretchable sealant support member.

3. The spacer and sealant assembly of claim 2 further comprising a topcoat having a desiccant and joined to said sealant.

4. The spacer and sealant assembly of claim 3 wherein said shim is undulating along a longitudinal axis.

5. The spacer and sealant assembly of claim 4 wherein said stiffener is adhered to said stretchable sealant support member by a first adhesive.

6. The spacer and sealant assembly of claim 5 wherein said stiffener is adhered to said shim by a second adhesive.

7. The spacer and sealant assembly of claim 6 wherein said shim is adhered to said stretchable sealant support member by a third adhesive.

8. A spacer and sealant assembly comprising: a stretchable sealant support member having a planar surface bounded by first and second edges wherein said first and second edges are crimped to form at least one pleated portion; a stiffener in contact with said planar surface of said sealant support member; a shim undulating along a longitudinal axis and partially in contact with said first and second edges of said stretchable sealant support member wherein said at least one pleated portion forms at least one bendable prismatic cell; and a sealant joined to at least said first and second edges of said sealant support member.

9. The spacer and sealant assembly of claim 8 further comprising a topcoat having a desiccant and joined to said sealant.

10. The spacer and sealant assembly of claim 9 wherein said stiffener is adhered to said stretchable sealant support member by a first adhesive.

11. The spacer and sealant assembly of claim 10 wherein said stiffener is further adhered to said shim by a second adhesive.

12. The spacer and sealant assembly of claim 11 wherein said shim is adhered to said stretchable sealant support member by a third adhesive.

13. The spacer and sealant assembly of claim 12 wherein said assembly is coilable.

14. A window assembly comprising:

a stretchable sealant support member having a planar surface bounded by first and second edges wherein said first and second edges have at least one pleated portion;

a shim having at least one undulating portion in contact with said first and second edges of said stretchable sealant support member so that said at least one pleated portion and the shim is configured to facilitate bending;

a sealant joined to at least said first and second edges of said sealant support member and having first and second glass engaging surfaces; a first glass structure adhered to said first glass engaging surface of said sealant; and a second glass structure adhered to said second glass engaging surface.

15. The window assembly of claim 14 further comprising a stiffener in contact with said stretchable sealant support member.

16. The window assembly of claim 15 further comprising a topcoat having a desiccant joined to said sealant.

17. The window assembly of claim 16 wherein said shim is undulating in a longitudinal axis.

18. The window assembly of claim 17 wherein said stiffener is adhered to said stretchable sealant support member by a first adhesive.

19. The window assembly of claim 18 wherein said stiffener is adhered to said shim by a second adhesive.

20. The window assembly of claim 19 wherein said shim is adhered to said stretchable sealant support member by a third adhesive.

21. A window assembly comprising:

a sealant support member having a planar surface bounded by first and second edges wherein said first and second edges are crimped to form at least one pleated portion;

a stiffener in contact with said planar surface of said sealant support member; a shim undulating along a longitudinal axis and partially in contact with said first and second edges of said stretchable sealant support member forms at least one bendable prismatic cell;

a sealant joined to at least said first and second edges of said sealant support member and having substantially parallel first and second glass engaging surfaces;

a first glass structure adhered to said first glass engaging surface of said sealant; and a second glass structure adhered to said second glass engaging surface of said sealant.

22. The window assembly of claim 21 further comprising a topcoat having a desiccant joined to said sealant.

23. The window assembly of claim 21 wherein said stiffener is adhered to said stretchable sealant support member by a first adhesive.

24. The window assembly of claim 23 wherein said stiffener is adhered to said shim by a second adhesive.

25. The window assembly of claim 24 wherein said shim is adhered to said stretchable sealant support member by a third adhesive.

26. A method for forming a spacer sealant strip for joining and hermetically sealing two substantially parallel surfaces comprising the steps of:

forming a shim generally undulating along a longitudinal axis;

at least partially crimping first and second edges of a stretchable sealant support member to form at least one partially pleated portion;

joining said shim to shim joining-surfaces of first and second edges of a stretchable sealant support member so that said at least one pleated portion extends generally inward within at least one void created by the undulations to form at least one bendable prismatic cell;

joining a stiffener to a planar surface of said stretchable sealant support member; and applying a deformable adhesive sealant to at least sealant joining surface of said first and second edges of said stretchable sealant support member.

* * * * *